US006051532A

United States Patent [19]

Burberry et al.

[11] Patent Number: 6,051,532

[45] Date of Patent: Apr. 18, 2000

[54] POLYMERIC ABSORBER FOR LASER-COLORANT TRANSFER

[75] Inventors: Mitchell Burberry; Douglas R. Robello, both of Webster, N.Y.; Richard T. Spring, Plainsboro, N.J.; Glenn T. Pearce, Webster, N.Y.

[73] Assignee: Eastman Kodak Company, Rochester, N.Y.

[21] Appl. No.: 09/193,342

[22] Filed: Nov. 16, 1998

[51] Int. Cl.[7] ..... B41M 5/035; B41M 5/38

[52] U.S. Cl. ..... 503/227; 428/195; 428/913; 428/914; 430/945

[58] Field of Search ..... 8/471; 428/195, 428/913, 914; 430/945; 503/227

[56] References Cited

U.S. PATENT DOCUMENTS

| | | | |
|---|---|---|---|
| 4,942,141 | 7/1990 | DeBoer et al. | 503/227 |
| 5,667,860 | 9/1997 | Burns et al. | 428/64.1 |

*Primary Examiner*—Bruce H. Hess
*Attorney, Agent, or Firm*—Harold E. Cole

[57] ABSTRACT

A colorant-donor element for thermal colorant transfer comprising a support having thereon a colorant layer having a laser radiation-absorbing material associated therewith, wherein the laser radiation-absorbing material comprises a polymer containing within its repeat units a laser radiation-absorbing chromophore comprising an organic moiety having a plurality of conjugated double bonds and an optical absorption of from about 400 to about 1200 nm, and wherein the organic moiety is capable of forming at least two covalent bonds to the polymer backbone.

20 Claims, No Drawings

POLYMERIC ABSORBER FOR LASER-COLORANT TRANSFER

CROSS REFERENCE TO RELATED APPLICATION

Reference is made to commonly-assigned copending U.S. patent application Ser. No. 09/192,769, filed of even date herewith, entitled Ionic Polymeric Absorber For Laser-Colorant Transfer by Noonan et al., the teachings of which are incorporated herein by reference.

FIELD OF THE INVENTION

This invention relates to a polymeric absorber used in laser-colorant transfer donor elements. In particular, the polymeric absorber is useful in laser colorant-transfer systems designed for digital color halftone proofing.

BACKGROUND OF THE INVENTION

In order to approximate the appearance of continuous-tone (photographic) images via ink-on-paper printing, the commercial printing industry relies on a process known as halftone printing. In halftone printing, color density gradations are produced by printing patterns of dots or areas of varying sizes, but of the same color density, instead of varying the color density continuously as is done in photographic printing.

There is an important commercial need to obtain a color proof image before a printing press run is made. It is desired that the color proof will accurately represent at least the details and color tone scale of the prints obtained on the printing press. In many cases, it is also desirable that the color proof accurately represent the image quality and halftone pattern of the prints obtained on the printing press. In the sequence of operations necessary to produce an ink-printed, full-color picture, a proof is also required to check the accuracy of the color separation data from which the final three or more printing plates or cylinders are made. Traditionally, such color separation proofs have involved silver halide photographic, high-contrast lithographic systems or non-silver halide light-sensitive systems which require many exposure and processing steps before a final, full-color picture is assembled.

Colorants that are used in the printing industry are insoluble pigments. By virtue of their pigment character, the spectrophotometric curves of the printing inks are often unusually sharp on either the bathochromic or hypsochromic side. This can cause problems in color proofing systems in which colorants, as opposed to pigments, are being used. It is very difficult to match the hue of a given ink using a single colorant.

In U.S. Pat. No. 5,126,760, a process is described for producing a direct digital, halftone color proof of an original image on a colorant-receiving element. The proof can then be used to represent a printed color image obtained from a printing press. The process described therein comprises:

a) generating a set of electrical signals which is representative of the shape and color scale of an original image;

b) contacting a colorant-donor element comprising a support having thereon a colorant layer and an infrared-absorbing material with a first colorant-receiving element comprising a support having thereon a polymeric, colorant image-receiving layer;

c) using the signals to imagewise-heat by means of a diode laser the colorant-donor element, thereby transferring a colorant image to the first colorant-receiving element; and d) retransferring the colorant image to a second colorant image-receiving element which has the same substrate as the printed color image.

In the above process, multiple colorant-donors are used to obtain a complete range of colors in the proof. For example, for a full-color proof, four colors: cyan, magenta, yellow and black are normally used.

By using the above process, the image colorant is transferred by heating the colorant-donor containing the infrared-absorbing material with the diode laser to volatilize the colorant, the diode laser beam being modulated by the set of signals which is representative of the shape and color of the original image, so that the colorant is heated to cause volatilization only in those areas in which its presence is required on the colorant-receiving layer to reconstruct the original image.

Similarly, a thermal transfer proof can be generated by using a thermal head in place of a diode laser as described in U.S. Pat. No. 4,923,846. Commonly available thermal heads are not capable of generating halftone images of adequate resolution but can produce high quality continuous tone proof images which are satisfactory in many instances. U.S. Pat. No. 4,923,846 also discloses the choice of mixtures of colorants for use in thermal imaging proofing systems. The colorants are selected on the basis of values for hue error and turbidity. The Graphic Arts Technical Foundation Research Report No. 38, "Color Material" (58–(5) 293–301, 1985) gives an account of this method.

An alternative and more precise method for color measurement and analysis uses the concept of uniform color space known as CIELAB in which a sample is analyzed mathematically in terms of its spectrophotometric curve, the nature of the illuminant under which it is viewed and the color vision of a standard observer. For a discussion of CIELAB and color measurement, see *Principles of Color Technology,* 2nd Edition, F. W. Billmeyer, p. 25–110, Wiley-Interscience and *Optical Radiation Measurements,* Volume 2, F. Grum, p. 33–145, Academic Press.

In using CIELAB, colors can be expressed in terms of three parameters: $L^*$, $a^*$ and $b^*$, where $L^*$ is a lightness function, and $a^*$ and $b^*$ define a point in color space. Thus, a plot of $a^*$ vs. $b^*$ values for a color sample can be used to accurately show where that sample lies in color space, i.e., what its hue is. This allows different samples to be compared for hue if they have similar density and $L^*$ values.

In color proofing in the printing industry, it is important to be able to match the proofing ink references provided by the International Prepress Proofing Association. These ink references are density patches made with standard 4-color process inks and are known as SWOP® (Specifications Web Offset Publications) Color Aims. For additional information on color measurement of inks for web offset proofing, see "Advances in Printing Science and Technology", Proceedings of the 19th International Conference of Printing Research Institutes, Eisenstadt, Austria, June 1987, J. T. Ling and R. Warner, p.55.

Infrared-absorbing colorants are used in colorant-donor elements for laser-colorant transfer for the purpose of absorbing the laser energy and converting the radiant energy into thermal energy in order to cause colorant transfer to a receiver element. One problem encountered in the use of infrared colorants is that these colorants often exhibit some absorption in the visible spectrum. In the event that some or all of the infrared colorant is transferred along with the colorant, this absorption may spoil the color purity or hue of the transferred image colorant.

DESCRIPTION OF RELATED ART

U.S. Pat. No. 4,942,141 relates to certain squarylium laser-absorbing dyes for a laser-induced thermal material transfer system. While these dyes are useful for the intended purposed, there is a need for additional laser-absorbing materials with narrow absorption bands at other, selected wavelengths and exhibiting different solvent and film compatibilities.

U.S. Pat. No. 5,667,860 discloses the use of polymeric cyanine dyes for reduced bubble formation in optical recording elements. However, this patent relates to optical memory devices and not to thermal transfer imaging systems.

It is an object of this invention to provide a colorant-donor element for laser-induced thermal colorant transfer which effectively converts laser excitation to heat and which exhibits better film forming characteristics and less color contamination from absorber materials than those of the prior art.

SUMMARY OF THE INVENTION

This and other objects are achieved in accordance with this invention which relates to a colorant-donor element for thermal colorant transfer comprising a support having thereon a colorant layer having a laser radiation-absorbing material associated therewith, wherein the laser radiation-absorbing material comprises a polymer containing within its repeat units a laser radiation-absorbing chromophore comprising an organic moiety having a plurality of conjugated double bonds and an optical absorption of from about 400 to about 1200 nm, and wherein the organic moiety is capable of forming at least two covalent bonds to the polymer backbone.

DESCRIPTION OF THE PREFERRED EMBODIMENTS

In a preferred embodiment of the invention, the laser radiation-absorbing material is a polymer containing a repeat unit having the following formula:

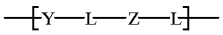

wherein

Y is a divalent moiety, such as substituted or unsubstituted tetramethylene, hexamethylene, 1,3-phenylene, 1,4-phenylene, 2,4-tolylene, 4,4'-diphenylmethylidine or 1,3-cyclohexyl, 1,4-cyclohexyl, etc.;

L is a difunctional linking group such as a carbamate, ester, amide, ether, amine, imide, carbonate or sulfonate group; and Z is a laser radiation-absorbing chromophore comprising an organic moiety having multiple, conjugated double bonds and an optical absorption of from about 400 to about 1200 nm, In another preferred embodiment, L is a carbamate or an ester. In yet another preferred embodiment, Y is tetramethylene, hexamethylene, 5-t-butyl-1,3-phenylene, or 2,4-tolylene.

Examples of Z useful in the invention include the following:

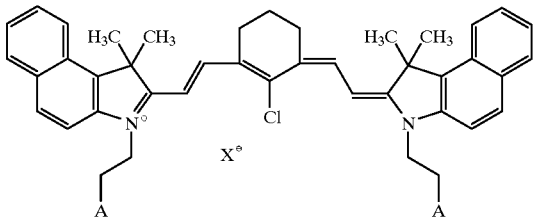

or

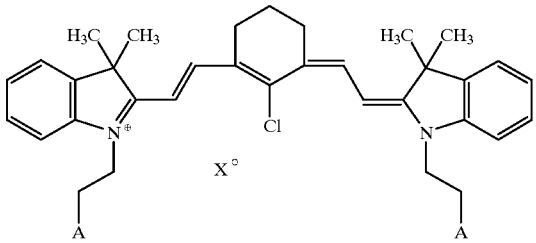

wherein A indicates the points of attachment to the rest of the polymer backbone, and $X^-$ is a counter ion such as chloride, bromide, p-toluene sulfonate, methane sulfonate, trifluoromethane sulfonate, trifluoroacetate, heptafluorobutyrate, heptafluorobutyl sulfonate, tetrafluoroborate, perchlorate, etc.

Some examples of laser radiation-absorbing polymers useful in the invention include the following:

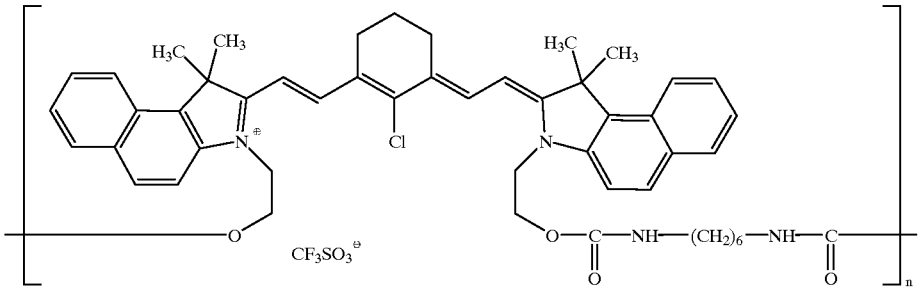

Polyurethane PU1

-continued
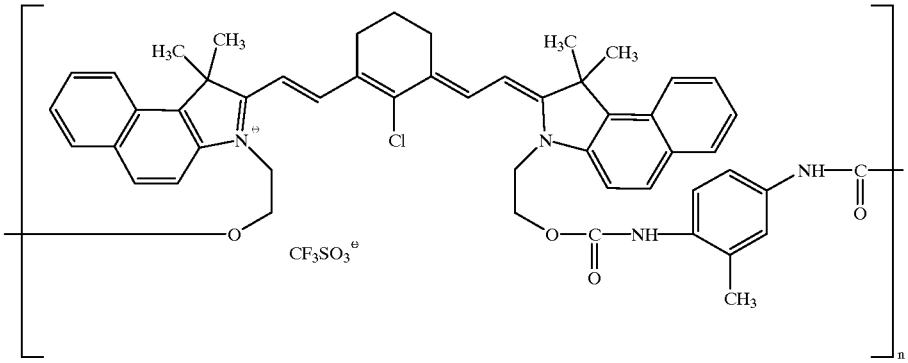
Polyurethane PU2
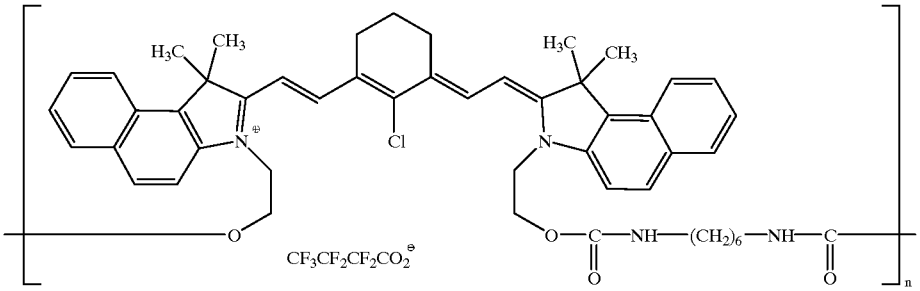
Polyurethane PU3
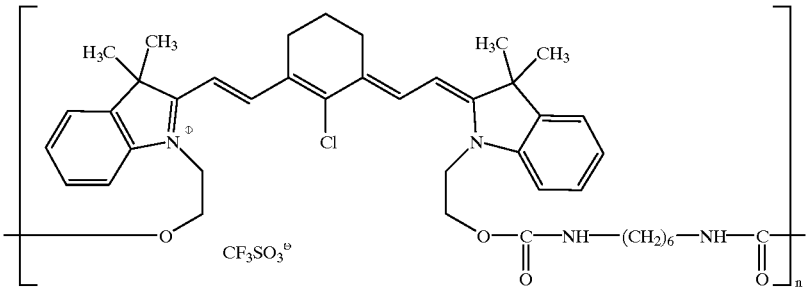
Polyurethane PU4
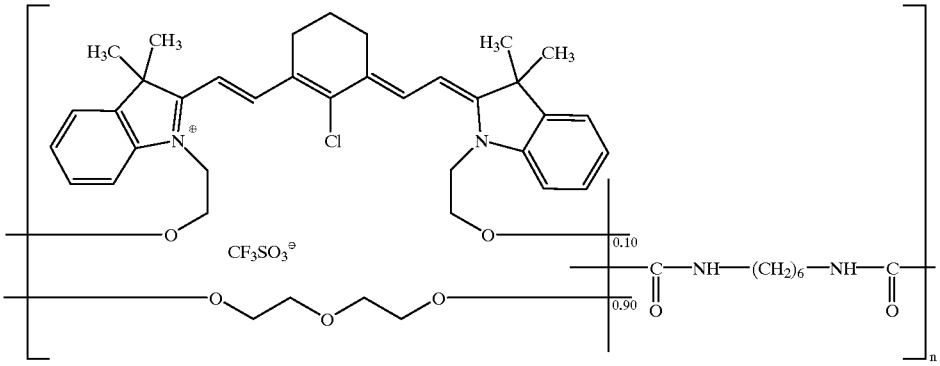
Polyurethane PU5

-continued
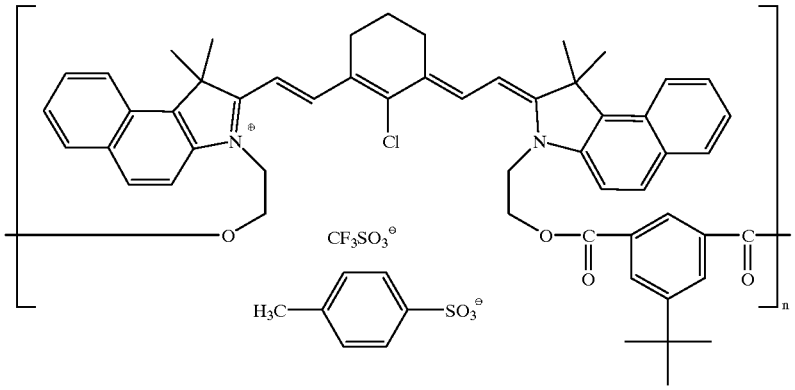
Polyester PE1
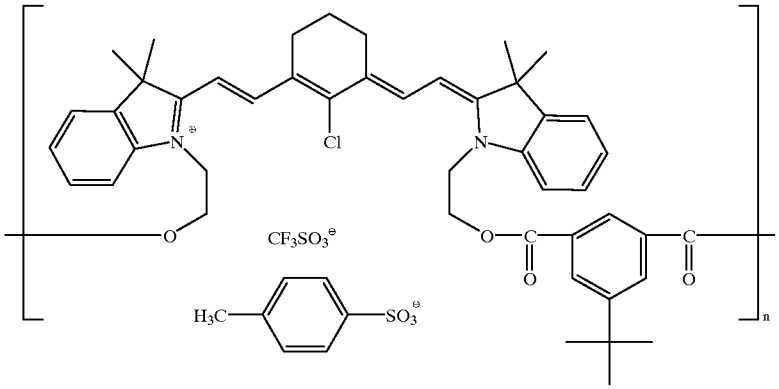
Polyester PE2
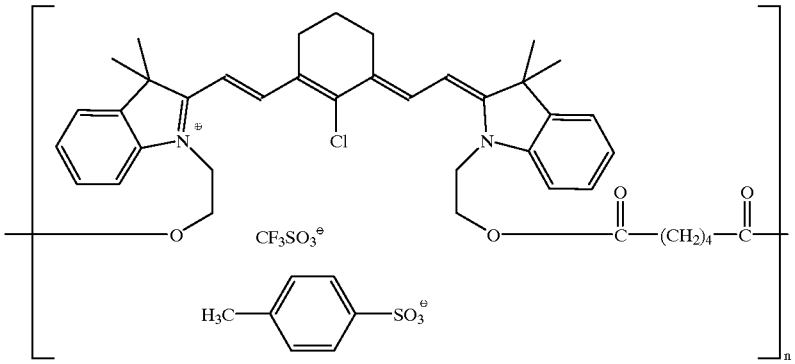
Polyester PE3
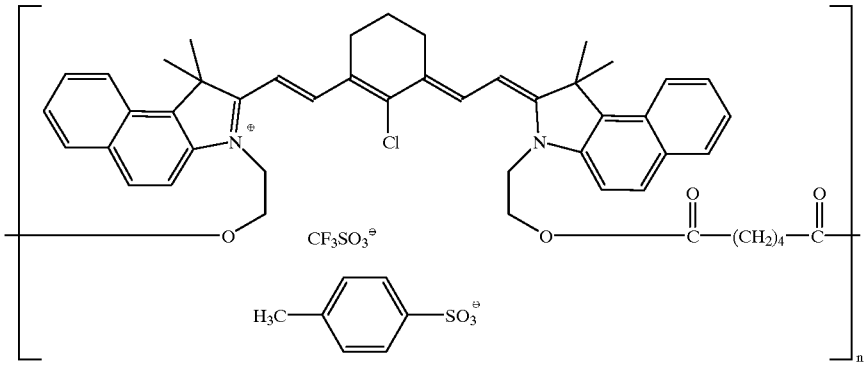
Polyester PE4

-continued

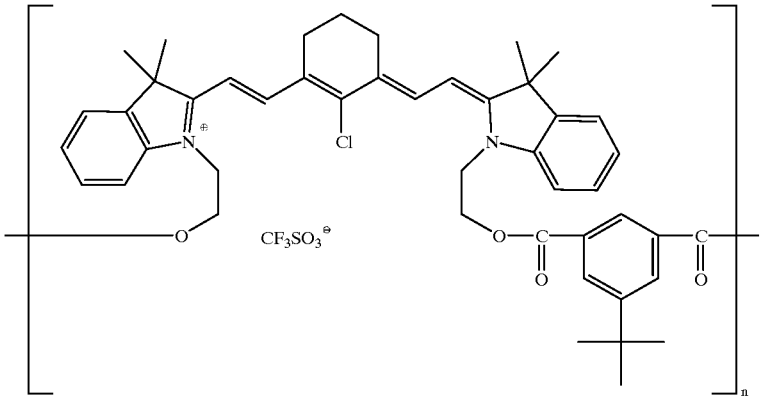

Polyester PE5

The syntheses of these polymers are described in the examples hereafter.

The above-described laser radiation-absorbing polymer preferably possesses a molecular weight between about 1000 and 500,000 g/mol., and, more preferably, a molecular weight between about 2000 and 50,000 g/mol.

The above-described laser radiation-absorbing polymer may be employed in any concentration which is effective for the intended purpose. In general, good results have been obtained at a concentration from about 0.05 to about 0.5 $g/m^2$ within the colorant layer itself or in an adjacent layer. In a preferred embodiment, the laser radiation-absorbing polymer is located in the colorant layer along with the image dye or pigment, which is a dye or pigment different from the laser radiation-absorbing chromophore.

The donor elements may optionally contain between the image colorant or pigment bearing layer and the support a sub or barrier sub such as those disclosed in U.S. Pat. Nos. 4,695,288 and 4,737,486 and may include layers formed from organo-titanates, silicates, or aluminates, and the like. Preferably, a layer formed from tetrabutyltitanate is used, available commercially as Tyzor TBT® (DuPont Corp.).

Colorants useful in the invention include both pigments and dyes. Pigments which can be used in the invention include the following: organic pigments such as metal phthalocyanines, e.g., copper phthalocyanine, quinacridones, epindolidiones, Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monstral® Blue G (C.I. No. Pigment Blue 15); Monstral® Blue BT 383D (C.I. No. Pigment Blue 15); Monstral® Blue G BT 284D (C.I. No. Pigment Blue 15); Monstral® Green GT 751D (C.I. No. Pigment Green 7) or any of the materials disclosed in U.S. Pat. Nos. 5,171,650, 5,672,458 or 5,516,622, the disclosures of which are hereby incorporated by reference.

Dyes useful in the invention include the following: Anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM®. and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. The above dyes may be employed singly or in combination. Combinations of pigments and/or dyes can also be used.

The colorants used in the invention may be employed at a coverage of from about 0.02 to about 1 $g/m^2$.

The process of obtaining an image with the colorant-donor elements of this invention has been described in U.S. Pat. No. 5,126,760 and is conveniently obtained on commercially-available laser thermal proofing systems such as the Kodak Approval® system, or the Creo Trendsetter® Spectrum system. Typically, a receiver sheet is placed on a rotating drum followed by successive placements of the individual cyan, magenta, yellow and black donor elements whereby the image for each color is transferred by image-wise exposure of the laser beam through the backside of the donor element.

The colorants in the colorant-donor of the invention can optionally be dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; polyvinyl butyrate; copolymers of maleic anhydride with vinyl ethers such as methyl vinyl ether; polycyanoacrylates; a polycarbonate; poly(vinyl acetate); poly(styrene-co-acrylonitrile); a polysulfone or a poly(phenylene oxide). The binder may be used at a coverage of from about 0.1 to about 5 $g/m^2$.

The colorant layer of the colorant-donor element may be coated on the support or printed thereon by a printing technique such as a gravure process.

Any material can be used as the support for the colorant-donor element of the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyetherimides. The support generally has a thickness of from about 5 to about 200 $\mu$m.

The receiving element that is used with the colorant-donor element of the invention usually comprises a support having thereon a colorant image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the colorant-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used.

The image-receiving layer may comprise, for example, a polycarbonate, a polyurethane, a polyester, poly(vinyl chloride), poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or mixtures thereof. The image-receiving layer may be present in any amount which is effective for the intended purpose. In general, good results have been obtained at a coverage of from about I to about 5 g/m$^2$.

As noted above, the colorant-donor elements of the invention are used to form a colorant transfer image. Such a process comprises imagewise-heating a colorant-donor element as described above and transferring a colorant image to a receiving element to form the colorant transfer image.

The colorant-donor element of the invention may be used in sheet form or in a continuous roll or ribbon. If a continuous roll or ribbon is employed, it may have only the colorants thereon as described above or may have alternating areas of other different colorants or pigments or combinations, such as sublimable cyan and/or yellow and/or black dyes or other colorants. Such colorants are disclosed in U.S. Pat. No. 4,541,830, the disclosure of which is hereby incorporated by reference. Thus, one-, two-, three- or four-color elements (or higher numbers also) are included within the scope of the invention.

A laser is used to transfer colorant from the colorant-donor elements of the invention. It is preferred to use a diode laser since it offers substantial advantages in terms of its small size, low cost, stability, reliability, ruggedness, and ease of modulation Lasers which can be used to transfer colorant from colorant-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in U.S. Pat. No. 5,268,708, the disclosure of which is hereby incorporated by reference.

Spacer beads may be employed in a separate layer over the colorant layer of the colorant-donor element in the above-described laser process in order to separate the donor from the receiver during colorant transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the receiver as described in U.S. Pat. No. 4,876,235, the disclosure of which is hereby incorporated by reference. The spacer beads may be coated with a polymeric binder if desired.

The use of an intermediate receiver with subsequent retransfer to a second receiving element may also be employed in the invention as described in U.S. Pat. No. 5,126,760. A multitude of different substrates can be used to prepare the color proof (the second receiver) which is preferably the same substrate as that used for the printing press run. Thus, this one intermediate receiver can be optimized for efficient colorant uptake without colorant-smearing or crystallization.

Optionally, the paper may be pre-laminated or precoated with an image receiving or colorant barrier layer in a dual-laminate process such as that described in U.S. Pat. No. 5,053,381. In addition, the receiver sheet may be an actual paper proofing stock or a simulation thereof with an optional laminate overcoat to protect the final image.

Examples of substrates which may be used for the second receiving element (color proof) include the following: Flo Kote Cover® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Consolith Gloss® (Consolidated Papers Co.), Ad-Proof Paper® (Appleton Papers, Inc.) and Mountie Matte® (Potlatch Inc.).

As noted above, after the colorant image is obtained on a first colorant-receiving element, it may be retransferred to a second colorant image-receiving element. This can be accomplished, for example, by passing the two receivers between a pair of heated rollers. Other methods of retransferring the colorant image could also be used such as using a heated platen, use of pressure and heat, external heating, etc.

Also as noted above, in making a color proof, a set of electrical signals is generated which is representative of the shape and color of an original image. This can be done, for example, by scanning an original image, filtering the image to separate it into the desired additive primary colors, i.e., red, blue and green, and then converting the light energy into electrical energy. The electrical signals are then modified by computer to form the color separation data which are used to form a halftone color proof. Instead of scanning an original object to obtain the electrical signals, the signals may also be generated by computer. This process is described more fully in *Graphic Arts Manual,* Janet Field ed., Arno Press, N.Y. 1980 (p. 358ff), the disclosure of which is hereby incorporated by reference.

A thermal colorant transfer assemblage of the invention comprises a) a colorant-donor element as described above, and b) a colorant-receiving element as described above, the colorant-receiving element being in a superposed relationship with the colorant-donor element so that the colorant layer of the donor element is in contact with the colorant image-receiving layer of the receiving element.

The above assemblage comprising these two elements may be preassembled as an integral unit when a monochrome image is to be obtained. This may be done by temporarily adhering the two elements together at their margins. After transfer, the colorant-receiving element is then peeled apart to reveal the colorant transfer image.

When a three-color image is to be obtained, the above assemblage is formed three times using different colorant-donor elements. After the first colorant is transferred, the elements are peeled apart. A second colorant-donor element (or another area of the donor element with a different colorant area) is then brought in register with the colorant-receiving element and the process repeated. The third color is obtained in the same manner. A four color image may also be obtained using the colorant-donor element of the invention.

The following examples are provided to illustrate the invention.

EXAMPLES

Synthesis of Cyanine Dye Intermediate A

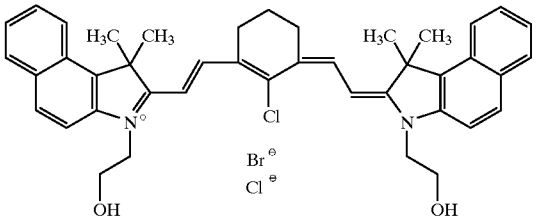

First, 3-(2-hydroxyethyl)- 1,1,2-trimethyl- 1H-benz[e] indolium bromide (CAS 6761-94-0) was synthesized as follows: A 250 mL reaction vessel was charged with 50 g (0.24 mol) of 1,1,2-trimethyl-1H-benz[e]indole and 68 mL (0.96 mol) of 2-bromoethanol. The resulting solution was held at 100° C. for 24 h, and then cooled to room temperature. The product was precipitated into 500 mL of isopropanol, filtered, and dried to provide 49.2 g (61% yield) of a gray solid.

A 100 mL reaction vessel was charged with 20.0 g (0.060 mol) of 3-(2-hydroxyethyl)- 1,1,2-trimethyl-1H-benz[e] indolium bromide thus prepared, plus 10.74 g (0.030 mol) of N-[[2-chloro-3-[(phenylamino)methylene]-1-cyclohexen-1-yl]methylene]-benzenamine monohydrochloride (CAS 63857-00-1), 12.8 mL (0.030 mol) of acetic anhydride, and 140 mL of acetonitrile. The reaction mixture was heated to reflux, and 10.6 mL (0.070 mol) of triethylamine was added slowly. An additional 70 mL of acetonitrile was added. The reaction mixture was held at reflux for 45 min, and then cooled to room temperature. The precipitated product was collected by filtration, and dried to produce 15.2 g of a bronze solid dye intermediate which contains mixed bromide and chloride counterions.

Synthesis of Monomer A1:

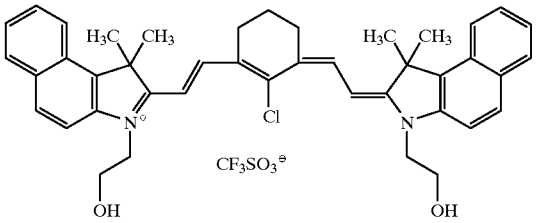

Cyanine Dye Intermediate A (10.0 g, 0.014 mol) was suspended in 220 mL of methanol at reflux, and 11 mL (0.12 mol) of trifluoromethane sulfonic acid was added slowly. The reaction mixture was cooled to room temperature, 250 mL of water was added, and the precipitated product was filtered. After washing the product with water and drying in vacuo, 10.5 g (66% yield) of Monomer A1 as bronze crystals was obtained.

Synthesis of Monomer A2:

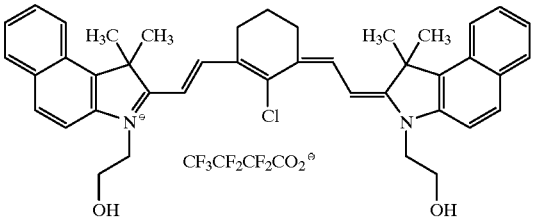

A stirred suspension of 12.0 g (0.12 mol) of potassium bicarbonate in 25 mL of methanol was treated dropwise with 14.6 mL (0.112 mol) of heptafluorobutyric acid. This mixture was added to 11.0 g (0.15 mol) Cyanine Dye Intermediate A in 240 mL of methanol, and the resulting suspension was held at reflux for 1 h. After cooling to room temperature, the reaction mixture filtered, and the filtrate was diluted with 430 nL of water. The precipitated product was filtered and dried in vacuo to provide 7.56 g (59% yield) of a green solid.

Synthesis of Cyanine Dye Intermediate B

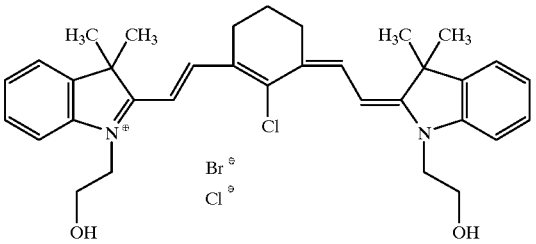

First, 3-(2-hydroxyethyl)- 1,1,2-trimethyl-3H-indolium bromide (CAS 6761-94-0) was synthesized as follows: A 100 mL reaction vessel was charged with 23.9 g (0.150 mol) of 2,3,3-trimethyl-3H-indole and 37.56 g (0.301 mol) of 2-bromoethanol. The resulting solution was held at 100° C. for 18 h, and then cooled to room temperature. Diethyl ether (60 mL) was added, then the product was filtered, and dried in vacuo to provide 42.4 g (99% yield) of a tan solid.

A 250 mL reaction vessel was charged with 9.67 g (0.034 mol) of 1-(2-hydroxyethyl)-2,3,3-trimethyl-3H-benz[e] indolium bromide thus prepared, plus 6.11 g (0.017 mol) of N-[[2-chloro-3-[(phenylamino)methylene]-1-cyclohexen-1-yl]methylene]-benzenamine monohydrochloride (CAS 63857-00-1), 1.6 mL (0.017 mol) of acetic anhydride, and 150 mL of acetonitrile. The reaction mixture was heated to reflux, and 5.92 mL (0.042 mol) of triethylamine was added slowly. The reaction mixture was held at reflux for 4 h, and then cooled to room temperature. The solvent was removed at reduced pressure to deposit the crude cyanine dye intermediate which was used directly in the next step.

Synthesis of Monomer B1:

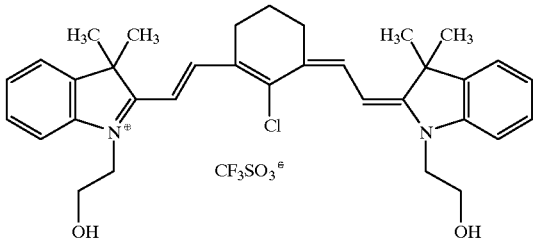

The crude Cyanine Dye Intermediate B was suspended in 250 mL of methanol, brought to reflux, and treated with 9.6 mL (0.108 mol) of trifluoromethane sulfonic acid. The reaction mixture was cooled to room temperature, and then 200 mL of water was added. The precipitated product was filtered and dried in vacuo to deposit 5.95 g (67% yield) of a green powder.

Synthesis of Polyurethane PU1 from Monomer A1

A mixture 5.00 g (0.00631 mol) of Monomer A1, 1.06 g (0.00631 mol) of 1,6-diisocyanatohexane, 25 mL of dry tetrahydrofuran, and a catalytic amount of dibutyl tin oxide was heated at reflux under nitrogen for 2.5 h. Most of the tetrahydrofuran was evaporated under reduced pressure, then 50 mL of N,N-dimethylformamide was added to bring the precipitated polymer into solution, and then the product was precipitated into 500 mL of water. The product was filtered and dried in vacuo to obtain 6.00 g (99% yield) of a lustrous blue-green powder. Size exclusion chromatography (polystyrene standards) indicated a weight average molecular weight for this sample of 18,000 g/mol.

Synthesis of Polyurethane PU2 from Monomer A1

A mixture 10.00 g (0.013 mol) of Monomer A1, 1.94 mL (0.012 mol) of 1,6-diisocyanatohexane, 50 mL of dry tetrahydrofuran, and a catalytic amount of dibutyl tin oxide was heated at reflux under nitrogen for 2 h. Most of the tetrahydrofuran was evaporated under reduced pressure, then 50 mL of N,N-dimethylformamide was added to bring the precipitated polymer into solution, and then the product was precipitated into 750 mL of water. The product was filtered and dried in vacuo to obtain 8.60 g (71% yield) of a lustrous blue-green powder. Size exclusion chromatography (polystyrene standards) indicated a weight average molecular weight for this sample of 20,500 g/mol.

Synthesis of Polyurethane PU3 from Monomer A2

A mixture 10.00 g (0.012 mol) of Monomer A2, 1.94 mL (0.012 mol) of 1,6-diisocyanatohexane, 50 mL of dry tetrahydrofuran, and a catalytic amount of dibutyl tin oxide was heated at reflux under nitrogen for 2.5 h. Sufficient N,N-dimethylformamide was added to bring the precipitated polymer into solution, and then the product was precipitated into 1000 mL of water. The product was filtered and dried in vacuo to obtain 6.38 g (53% yield) of a lustrous dark green powder. Size exclusion chromatography (polystyrene standards) indicated a weight average molecular weight for this sample of 8,000 g/mol.

Synthesis of Polyurethane PU4 from Monomer B1

A mixture of 5.00 g (0.0070 mol) of Monomer B1, 1.21 g of 1,6-diisocyanatohexane, 100 mL of dry tetrahydrofuran, and a catalytic amount of dibutyl tin diacetate was held at reflux under nitrogen for 4 h. The product was precipitated in water, filtered, and dried in vacuo.

Synthesis of Polyurethane PU5 from Monomer B1

A stirred mixture of 5.00 g (0.0297 mol) of vacuum distilled 1,6-diisocyanatohexane, 2.84 g (0.0267 mol) of vacuum distilled diethylene glycol, 2.08 g (0.00300 mol) of monomer B1, 100 mL of dry tetrahydrofuran, and a catalytic amount of dibutyl tin diacetate was held at reflux for 16 h. The polymer was precipitated into 500 mL of diethyl ether, and filtered. After drying in vacuo, 3.01 g (31% yield) of a reflective blue solid was obtained. The polymer showed an absorbance maximum of 784 nm in acetone solution. Size exclusion chromatography (polystyrene standards) showed a weight average molecular weight for this sample as 4,400 g/mol.

Synthesis of Polyester PE1 from Monomer A1

A stirred mixture of 4.836 g (0.00610 mol) of Monomer A1, 1.355 g (0.00610 mol) of 4-t-butylisophthalic acid, 0.72 g (0.0024 mol) of 4-dimethylaminopyridinium tosylate, 2.31 g (0.0183 mol) of diisopropylcarbodiimide, and 75 mL of dry dichloromethane under nitrogen was held at reflux for 24 h, and then cooled to room temperature. The polymer was precipitated into 600 mL of diethyl ether, and collected by filtration. The crude product was reprecipitated successively from dichloromethane into diethyl ether and then from dichloromethane into isopropanol. After drying in vacuo, 4.0 g (82% yield) of a green powder was obtained. Size exclusion chromatography (polystyrene standards) indicated a weight average molecular weight for this sample of 24,600 g/mol. The polymer exhibited an absorbance maximum of 831 nm in acetonitrile solution. This polymer had a mixture of toluene sulfonate and trifluoromethyl sulfonate counter ions.

Synthesis of Polyester PE2 from Monomer B1

A stirred mixture of 5.50 g (0.00793 mol) of Monomer B1, 1.76 g (0.00610 mol) of 4-t-butylisophthalic acid, 0.934 g (0.0032 mol) of 4,4-dimethylaminopyridinium tosylate, 3.00 g (0.024 mol) of diisopropylcarbodiimide, and 30 mL of dry dichloromethane under nitrogen was held at reflux for 24 h, and then cooled to room temperature. The polymer was precipitated into 600 mL of diethyl ether, and collected by filtration. After drying in vacuo, 6.31 g (91% yield) of a green powder was obtained. The polymer exhibited an absorbance maximum of 787 nm in acetone solution. This polymer had a mixture of toluene sulfonate and trifluoromethyl sulfonate counter ions.

Synthesis of Polyester PE3 from Monomer B1

A stirred mixture of 5.00 g (0.00721 mol) of Monomer B 1, 1.05 g (0.00718 mol) of adipic acid, 085 g (0.00289 mol) of 4-dimethylaminopyridinium tosylate, 2.73 g (0.0216 mol) of diisopropylcarbodiimide, and 90 mL of dry dichloromethane under nitrogen was held under reflux for 24 h, and then cooled to room temperature. The polymer was precipitated into 600 mL of diethyl ether, and collected by filtration. The crude product was again precipitated from dichloromethane into diethyl ether. After drying in vacuo, 3.57 g (62% yield) of green powder was obtained. Size exclusion chromatography (polystyrene standards) indicated a weight average molecular weight for this sample of 11,900 g/mol. The polymer exhibited an absorbance maximum of 831 nm in acetone solution. This polymer had a mixture of toluene sulfonate and trifluoromethyl sulfonate counter ions.

Synthesis of Polyester PE4 from Monomer A1

A stirred mixture of 5.53 g (0.00697 mol) of Monomer A1, 1.21 g (0.00828 mol) of adipic acid, 0.88 g (0.00279 mol) of 4-dimethylaminopyridinium tosylate, 2.64 g (0.0209 mol) of diisopropylcarbodiimide, and 90 mL of dry dichloromethane under nitrogen was held at reflux for 24 h, and then cooled to room temperature. The polymer was precipitated into 600 mL of diethyl ether, and collected by filtration. The crude product was then reprecipitated from dichloromethane into diethyl ether. After drying in vacuo 4.28 g (72% yield) of a blue-green solid was obtained. Size exclusion chromatography (polystyrene standards) showed a weight average molecular weight for this sample as 13,100 g/mol. The polymer showed an absorbance maximum of 826 nm with a shoulder at 761 nm in acetone solution. This polymer had a mixture of toluene sulfonate and trifluoromethyl sulfonate counter ions.

Synthesis of 4-dimethylaminopyridinium triflate (used in synthesis of PE5)

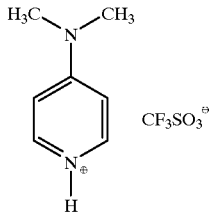

A 250 mL reaction vessel was charged with 1.18 mL (0.0133 mol) of trifluoromethanesulfonic acid and 100 mL of methanol. The solution was stirred and cooled to zero degrees by a ice bath. In a separate vessel, 1.63 g (0.0133 mol) of 4-dimethylaminopyridine was dissolved in 25 mL of methanol. This solution was added slowly to cooled acid solution. The two were allowed to stir for thirty minutes after all of the reagents had been added. The solvent was removed under reduced pressure and 2.66 g of product were recovered (73% yield).

Synthesis of Polyester PE5 from Monomer B1

A stirred mixture of 5.00 g (0.00721 mol) of Monomer B1, 1.60 g (0.00720 mol) of 4-t-butylisophthalic acid, 0.790 g (0.00290 mol) of 4-dimethylaminopyridinium triflate, 2.73 g (0.0216 mol) of diisopropylcarbodiinide, and 90 mL of dry dichloromethane under nitrogen was held at reflux for 24 h, and then cooled to room temperature. The polymer was precipitated into 600 mL of diethyl ether. The crude product was reprecipitated successively from dichloromethane into diethyl ether and then from dichloromethane into isopropanol. After drying in vacuo, 3.17 g (50% yield) of a purple crystalline solid was obtained. Size exclusion chromatography (polystyrene standards) indicated a weight average molecular weight for this sample of 13,100 g/mol. The polymer exhibited an absorbance maximum of 786 nm in acetone solution.

The following materials were used in the Examples:

IR1

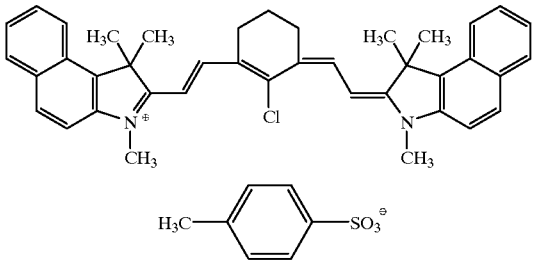

(Conventional Cyanine Laser-Absorber Dye)

-continued

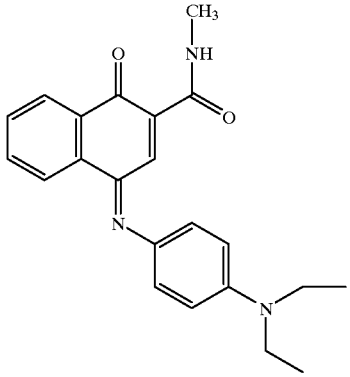

Cyan Image Dye 1

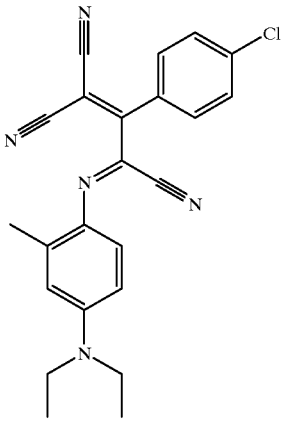

Cyan Image Dye 2

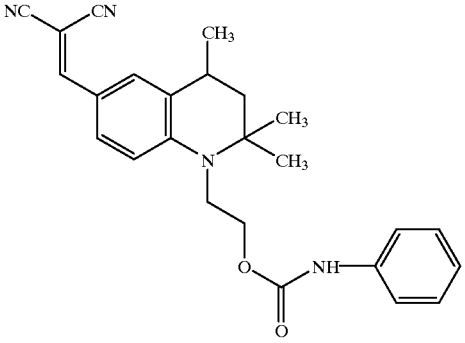

Yellow Image Dye

Example 1

Control C-1: Cyan donor element with conventional IR absorber dye

A cyan colorant-donor control element was prepared by coating a 100 μm thick poly(ethylene terephthalate) support with a solution containing 0.095 g of the Cyan Image Dye 1 as illustrated above, 0.019 g of the conventional Cyanine Laser-Absorbing Dye (IR1) as illustrated above, 0.095 g of cellulose acetate propionate binder (2.5% acetyl, 45% propionyl) in 14.79 g of methylene chloride using a 25 μm knife blade.

Element E-1: Cyan donor element with polymeric laser-absorber of the invention

This element was prepared the same as C-1 except using PU1 instead of IR1 and in an amount of 0.027 g of PU1 in order to match the infrared optical densities of the two samples.

Each element was then exposed to a focused diode laser beam at 830 nm wavelength on an apparatus similar to that described in U.S. Pat. No. 5,446,477. A Kodak Approval® Intermediate Receiver sheet Catalogue No. 831 5582, as described in U.S. Pat. Nos. 5,053,381 and 5,342,821, was mounted on the drum on an aluminum carrier plate, and the test donor sheet placed over the intermediate sheet with the coated side facing the Intermediate Receiver sheet. The prints were finished after imaging by laminating, in a Kodak Approval® Laminator, the imaged Intermediates to sheets of Champion 60-lb. Textweb® paper which were initially pre-laminated with Kodak Prelaminate sheets, Catalogue No. 173 9671, as described in U.S. Pat. Nos. 5,053,381 and 5,342,821, in the same laminator.

Colorimetric reflection measurements were made using an X-Rite Model 938 Spectrodensitometer. The results for the donors having matched transfer sensitivity are summarized in Table 1. The results are given as Status T Red (wanted) and Status T Blue (unwanted) reflection density as a function of exposure.

TABLE 1

Color Purity for Cyan Transfer

| | Control C-1 | | | Element E-1 | | |
|---|---|---|---|---|---|---|
| | Red | | | | | |
| Exposure (mJ/cm$^2$) | Density[1] | Blue Density[1] | Color Purity[2] | Red Density[1] | Blue Density[1] | Color Purity[2] |
| 643 | 0.85 | 0.23 | 3.70 | 1.44 | 0.31 | 4.65 |
| 583 | 1.10 | 0.30 | 3.67 | 1.41 | 0.34 | 4.15 |
| 523 | 1.13 | 0.23 | 3.53 | 1.43 | 0.33 | 4.33 |
| 463 | 1.19 | 0.35 | 3.40 | 1.45 | 0.30 | 4.83 |
| 403 | 1.29 | 0.38 | 3.39 | 1.45 | 0.25 | 5.80 |
| 343 | 1.25 | 0.32 | 3.91 | 1.24 | 0.19 | 6.53 |
| 283 | 0.85 | 0.10 | 8.50 | .081 | 0.07 | 11.57 |

[1]Status T density transferred minus the paper density
[2]Ratio of red/blue density The above results show that for a given exposure, Element E-1 of the invention had a higher ratio of wanted red density to unwanted blue density as compared to the control C-1 element. Thus, the purity of the transferred cyan color of the element of the invention is superior to the control element.

Example 2

Control C-2: yellow donor element with conventional laser-absorber IR1.

A yellow colorant-donor control element was prepared by coating a 100 $\mu$m thick poly(ethylene terephthalate) support with a solution containing 0.095 g of the Yellow Image Dye illustrated above, 0.019 g of the Cyanine Laser-Absorbing Dye (IR1) as illustrated above, 0.095 g of cellulose acetate propionate binder (2.5% acetyl, 45% propionyl) in 14.79 g of methylene chloride using a 25 $\mu$m knife blade.

Element E-2: Yellow Donor with the polymeric laser-absorber of the invention

This element was prepared the same as control C-2 except using PU1 instead of IR1.

The above elements were exposed and tested as in Example 1. The following results were obtained:

TABLE 2

Color Purity for Yellow Transfer

| | Control C-2 | | | Element E-2 | | |
|---|---|---|---|---|---|---|
| Exposure (mJ/cm$^2$) | Yellow Density[1] | Magenta Density[1] | Color Purity[2] | Yellow Density[1] | Magenta Density[1] | Color Purity[2] |
| 643 | 0.98 | 0.11 | 8.87 | 1.00 | 0.08 | 12.62 |
| 583 | 1.12 | 0.16 | 7.15 | 1.02 | 0.09 | 11.63 |
| 523 | 1.17 | 0.18 | 6.48 | 1.07 | 0.10 | 10.65 |
| 463 | 1.04 | 0.14 | 7.73 | 1.04 | 0.10 | 10.53 |
| 403 | 0.83 | 0.09 | 9.30 | 0.89 | 0.06 | 15.31 |
| 343 | 0.88 | 0.08 | 11.69 | 0.73 | 0.03 | 24.20 |
| 283 | 0.34 | 0.01 | 42.63 | 0.28 | 0.00 | 280.00 |

[1]Status T density transferred minus the paper density
[2]Ratio of yellow/magenta density The above results show that for a given exposure, Element E-2 of the invention had a higher ratio of wanted yellow density to unwanted magenta density as compared to the control element C-2. Thus, the purity of the transferred yellow color of the element of the invention is superior to the control element.

Example 3

Another set of cyan donors represented by Controls C-3 to C-6 and elements E-3 to E-7 of the invention were prepared as follows:

On a 100 $\mu$m thick poly(ethylene terephthalate) support was coated a sub layer of 0.13 g/m tetrabutyltitanate (Tyzor® TBT, DuPont Corp.) from a 85/15 (wt/wt) mixture of propyl acetate and n-butanol. The dye-containing layer coated on the sub layer was comprised of 0.16 g/m$^2$ cellulose acetate propionate (CAP-20, Eastman Chemicals), 0.134 g/m$^2$ Cyan Image Dye 1, 0.0314 g/m$^2$ Cyan Image Dye 2, 0.005 g/m$^2$ FC-431® surfactant (3M Corp.), and IR1 at levels listed in Table 4 for each coating example. The coating solvent was an 85/15 mixture (wt/wt) of n-propylacetate and n-propanol which also included from 7 to 15 wt. % methanol.

The elements containing the polymeric absorber of the invention were coated exactly as the coatings containing the control IR1, except that the solvent system was a 90/10 wt. % mixture of cyclopentanone and iso-butanol. The levels coated are also listed in Table 4.

The transmission optical density at 830 nm of all of the elements prior to imaging was measured and the values listed in Table 3.

These cyan elements were imaged on a Creo Trendsetter® Plate Writer with 830 nm diode lasers and modified for digital halftone proofing. A Kodak Approval® Intermediate Receiver sheet Catalogue No. 831 5582, as described in U.S. Pat. Nos. 5,053,381 and 5,342,821, was mounted on the drum on an aluminum carrier plate, and the test donor sheet placed over the intermediate sheet with the coated side facing the Intermediate Receiver sheet. The prints were finished after imaging by laminating, in a Kodak Approval® Laminator, the imaged Intermediates to sheets of Champion 60-lb. Textweb® paper which were initially pre-laminated with Kodak Prelaminate sheets, Catalogue No. 173 9671, as described in U.S. Pat. Nos. 5,053,381 and 5,342,821, in the same laminator. The Status T Cyan density and the CIE L* a* b* values for each cyan solid area were measured using an X-Rite 938 Spectrodensitometer, and a plot of cyan density vs. exposure was used to determine the donor sensitivity point for each coating listed in Table 3. This sensitivity point is defined as the laser exposure in milli-Joules per $cm^2$ at the film plane required to produce a "mid SWOP" cyan density of 1.3. The b* values were measured at the donor sensitivity point and are listed in Table 3. A more negative b* number is indicative of a lower amount of yellow color contamination.

TABLE 3

| Element | IR Dye | Coating Dry Coverage $g/m^2$ | Donor Optical Density @ 830 nm | Exposure[1] Sensitivity Point $mJ/cm^2$ | CIE b* |
|---|---|---|---|---|---|
| Control Samples | | | | | |
| C-4 | IR1 | 0.022 | 0.477 | 320 | −34.5 |
| C-5 | IR1 | 0.027 | 0.595 | 260 | −33.2 |
| C-6 | IR1 | 0.032 | 0.642 | 235 | −32.0 |
| C-7 | IR1 | 0.043 | 0.848 | 207 | −30.8 |
| Invention Examples | | | | | |
| E-4 | PU1 | 0.093 | 0.87 | 217 | −36.3 |
| E-5 | PU1 | 0.046 | 0.552 | 275 | −38.9 |
| E-6 | PU2 | 0.105 | 0.915 | 245 | −36.9 |
| E-7 | PU2 | 0.052 | 0.528 | 258 | −40.0 |
| E-8 | PU3 | 0.086 | 0.798 | 290 | −38.4 |

[1]Exposure required at a power setting of 10 watts, to produce a solid area cyan density of 1.3 (Status T)

The above data show that a more negative b* value is obtained with elements containing the polymeric IR dyes of the invention as compared to the control IR dye. This is indicative of a much lower level of unwanted yellow color contamination, and therefore a more accurate cyan hue.

The invention has been described in detail with particular reference to preferred embodiments thereof, but it will be understood that variations and modifications can be effected within the spirit and scope of the invention.

What is claimed is:

1. A colorant-donor element for thermal colorant transfer comprising a support having thereon a colorant layer having a laser radiation-absorbing material associated therewith, wherein said laser radiation-absorbing material comprises a polymer containing within its repeat units a laser radiation-absorbing chromophore comprising an organic moiety having a plurality of conjugated double bonds and an optical absorption of from about 400 to about 1200 nm, and wherein said organic moiety is capable of forming at least two covalent bonds to the polymer backbone.

2. The element of claim 1 wherein said polymer has the following formula:

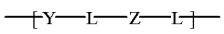

wherein

Y is a divalent moiety;

L is a difunctional linking group, and

Z is said laser radiation-absorbing chromophore.

3. The element of claim 2 wherein L is a carbamate, ester, amide, ether, amine, imide, carbonate or sulfonate group.

4. The element of claim 2 wherein Y is substituted or unsubstituted tetramethylene, hexamethylene, 1,3-phenylene, 1,4-phenylene, 2,4-tolylene, 4,4'-diphenylmethylidine, 1,3-cyclohexyl or 1,4-cyclohexyl.

5. The element of claim 2 wherein L is a carbamate or an ester.

6. The element of claim 2 wherein Y is tetramethylene, hexamethylene, 5-t-butyl- 1,3-phenylene, or 2,4-tolylene.

7. The element of claim 2 wherein said Z is

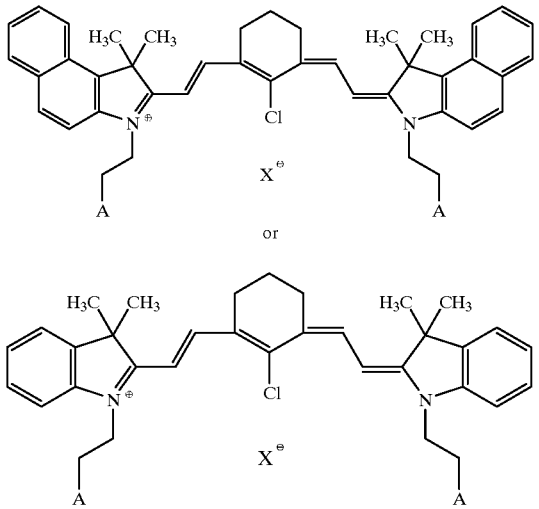

wherein A indicates the points of attachment to the rest of the polymer backbone, and $X^-$ is a counter ion.

8. A process of forming a colorant transfer image comprising imagewise-heating a colorant-donor element comprising a support having thereon a colorant layer having a laser radiation-absorbing material associated therewith, and transferring a colorant image to a colorant-receiving element to form said colorant transfer image, wherein said laser radiation-absorbing material comprises a polymer containing within its repeat units a laser radiation-absorbing chromophore comprising an organic moiety having a plurality of conjugated double bonds and an optical absorption of from about 400 to about 1200 nm, and wherein said organic moiety is capable of forming at least two covalent bonds to the polymer backbone.

9. The process of claim 8 wherein said polymer has the following formula:

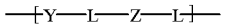

wherein

Y is a divalent moiety;

L is a difunctional linking group, and

Z is said laser radiation-absorbing chromophore.

10. The process of claim 9 wherein L is a carbamate, ester, amide, ether, amine, imide, carbonate or sulfonate group.

11. The process of claim 9 wherein Y is substituted or unsubstituted tetramethylene, hexamethylene, 1,3-phenylene, 1,4-phenylene, 2,4-tolylene, 4,4'-diphenylmethylidine, 1,3-cyclohexyl or 1,4-cyclohexyl.

12. The process of claim 9 wherein L is a carbamate or an ester.

13. The process of claim 9 wherein Y is tetramethylene, hexamethylene, 5-t-butyl-1,3-phenylene, or 2,4-tolylene.

14. The process of claim 9 wherein said Z is

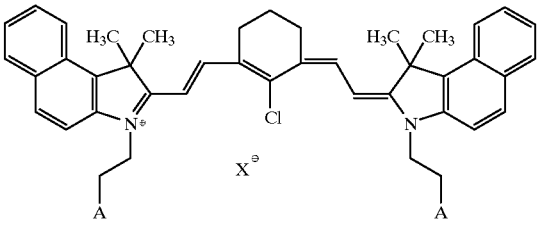

or

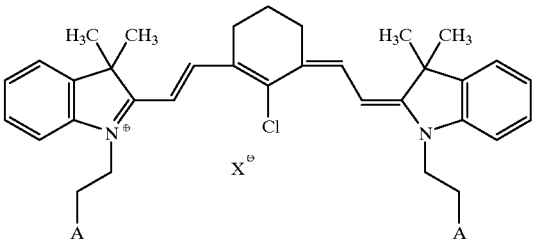

wherein A indicates the points of attachment to the rest of the polymer backbone, and $X^-$ is a counter ion.

15. A thermal colorant transfer assemblage comprising:

a) a colorant-donor element comprising a support having thereon a colorant layer having a laser radiation-absorbing material associated therewith, and b) a colorant-receiving element comprising a support having thereon a colorant image-receiving layer, said colorant-receiving element being in a superposed relationship with said colorant-donor element so that said colorant layer is in contact with said colorant image-receiving layer, wherein said laser radiation-absorbing material comprises a polymer containing within its repeat units a laser radiation-absorbing chromophore comprising an organic moiety having a plurality of conjugated double bonds and an optical absorption of from about 400 to about 1200 nm, and wherein said organic moiety is capable of forming at least two covalent bonds to the polymer backbone.

16. The assemblage of claim 15 wherein said polymer has the following formula:

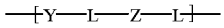

wherein

Y is a divalent moiety;

L is a difunctional linking group, and

Z is said laser radiation-absorbing chromophore.

17. The assemblage of claim 16 wherein L is a carbamate, ester, amide, ether, amine, imide, carbonate or sulfonate group.

18. The assemblage of claim 16 wherein Y is substituted or unsubstituted tetramethylene, hexamethylene, 1,3-phenylene, 1,4-phenylene, 2,4-tolylene, 4,4'-diphenylmethylidine, 1,3-cyclohexyl or 1,4-cyclohexyl.

19. The assemblage of claim 16 wherein L is a carbamate or an ester and Y is tetramethylene, hexamethylene, 5-t-butyl-1,3-phenylene, or 2,4-tolylene.

20. The assemblage of claim 16 wherein said Z is

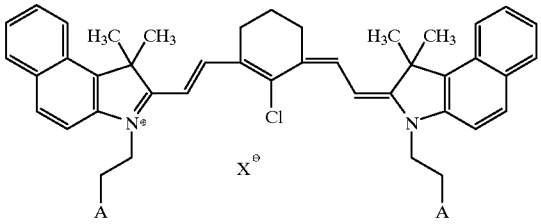

or

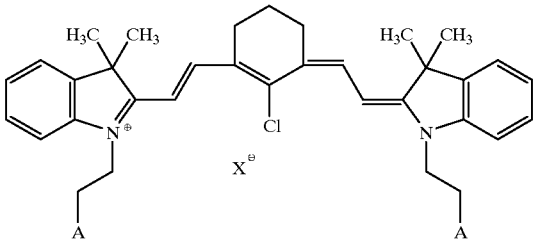

wherein A indicates the points of attachment to the rest of the polymer backbone, and $X^-$ is a counter ion.

* * * * *